US007633056B2

(12) United States Patent
Gaugiran et al.

(10) Patent No.: US 7,633,056 B2
(45) Date of Patent: Dec. 15, 2009

(54) PARTICLE MOVEMENT DEVICE

(75) Inventors: Stephanie Gaugiran, Grenoble (FR); Jerome Hazart, Grenoble (FR)

(73) Assignee: Commissariat a l'Energie Atomique, Paris (FR)

( * ) Notice: Subject to any disclaimer, the term of this patent is extended or adjusted under 35 U.S.C. 154(b) by 0 days.

(21) Appl. No.: 11/671,050

(22) Filed: Feb. 5, 2007

(65) Prior Publication Data

US 2007/0145256 A1 Jun. 28, 2007

Related U.S. Application Data

(63) Continuation of application No. 10/962,603, filed on Oct. 13, 2004, now Pat. No. 7,211,787.

(30) Foreign Application Priority Data

Oct. 14, 2003 (FR) ..... 03 50679

(51) Int. Cl.
*H05H 3/02* (2006.01)

(52) U.S. Cl. ..... 250/251; 385/130; 204/547

(58) Field of Classification Search ..... 250/251
See application file for complete search history.

(56) References Cited

U.S. PATENT DOCUMENTS

| | | | | |
|---|---|---|---|---|
| 3,778,612 | A * | 12/1973 | Ashkin | 250/251 |
| 5,210,404 | A * | 5/1993 | Cush et al. | 250/216 |
| 6,055,106 | A * | 4/2000 | Grier et al. | 359/566 |
| 6,744,038 | B2 * | 6/2004 | Wang et al. | 250/251 |
| 6,797,942 | B2 * | 9/2004 | Grier et al. | 250/251 |
| 6,833,542 | B2 * | 12/2004 | Wang et al. | 250/251 |
| 6,956,230 | B1 | 10/2005 | Gharib et al. | |
| 7,038,874 | B1 | 6/2006 | Wang et al. | |
| 7,109,473 | B2 | 9/2006 | Grier et al. | |
| 2003/0111594 | A1 | 6/2003 | Getin et al. | |
| 2004/0052489 | A1 * | 3/2004 | Duveneck et al. | 385/130 |
| 2004/0067167 | A1 | 4/2004 | Zhang et al. | |
| 2005/0070027 | A1 | 3/2005 | Gollier et al. | |

FOREIGN PATENT DOCUMENTS

| | | |
|---|---|---|
| WO | WO 00/69554 | 11/2000 |
| WO | WO 03/065774 A1 | 8/2003 |

OTHER PUBLICATIONS

David Rosenblatt, et al., Resonant Grating Waveguide Structures:, IEEE Journal of Quantum Electronics, vol. 33, No. 11, XP-000725006, Nov. 1, 1997, pp. 2038-2059.

Yusuke Ogura et al., "Optical levitation and translation of a microscopic particle by use of multiple beams generated by vertical-cavity surface-emitting laser array sources", Applied Optics, vol. 41, No. 27, XP-001130498, Sep. 20, 2002, pp. 5645-5654.

(Continued)

*Primary Examiner*—David A. Vanore
*Assistant Examiner*—Phillip A. Johnston
(74) *Attorney, Agent, or Firm*—Oblon, Spivak, McClelland, Maier & Neustadt, L.L.P.

(57) ABSTRACT

A process for moving a particle using a device, the device including a substrate, a wave guide and a grating formed on the wave guide. The process includes injecting light with wavelength λ into the wave guide, and diffracting the light transmitted through the guide to a medium with an index nsuper in which the particle is located, particle movement forces being generated by the diffraction of light from the grating.

39 Claims, 7 Drawing Sheets

OTHER PUBLICATIONS

S. Kawata et al., "Optically driven Mie particles in an evanescent field along a channeled wave guide", Optics Letters, vol. 21, No. 21, Nov. 1, 1996, pp. 1768-1770.
A. Ashkin et al., "Observation of a single-beam gradient force optical trap for dielectric particles", Optics Letters, vol. 11, No. 5, May 1986, pp. 288-290.
Toshiaki Suhara et al., "Integrated Optics Components and Devices Uing Periodic Structures", IEEE Journal of Quantum Electronics, vol. QE-22, No. 6, Jun. 1986, pp. 845-867.
A. Ashkin et al., "Optical Trapping and Manipulation of Viruses and Bacteria", Science, vol. 235, No. 4795, Mar. 20, 1987, pp. 1517-1520.

* cited by examiner

PARTICLE MOVEMENT DEVICE

CROSS-REFERENCE TO RELATED APPLICATION

This application is a Continuation of and claims the benefit of priority under 35 U.S.C. § 120 from U.S. Ser. No. 10/962,603, filed Oct. 13, 2004, and claims the benefit of priority under 35 U.S.C. § 119 from French Patent Application No. 03 50679, filed Oct. 14, 2003, the entire contents of each which are incorporated herein by reference.

DESCRIPTION

Technical Domain and Prior Art

The invention relates to the domain of particle movement and manipulation techniques by optical forces.

Envisaged applications include contact free movement of particles (balls made of different materials, nano-objects, cells or other biological objects) over long distances (several centimetres) and with predefined trajectories. Particle sort applications could also be envisaged based on interactions with light that are different depending on the nature of the particle.

The document by A. Ashkin et al. entitled "Observation of a single-beam gradient force optical trap for dielectric particles" Optics Letters, Vol. 11, No. 5, P. 288-290, 1986, shows that radiation pressure forces created by a focussed laser beam can be used to trap micrometric particles. This trap is actually created by the superposition of two opposing forces. The first force, called the diffusion force, is proportional to the intensity of the laser beam and is collinear with this beam. The second force, called the gradient force, is directed along the beam intensity gradient. Thus, if the laser is sufficiently focused, the intensity gradient is sufficient to counter the diffusion force. In the axial direction, the Gaussian profile generates two opposing gradient forces, which will centre the particle on the beam. The result is thus a trap stable in three dimensions.

There are trapping difficulties with this method, particularly for nanometric particles. For example, at least several seconds are necessary to trap a 36 nm diameter gold particle.

Furthermore, the device used to implement this method is fairly complicated.

Other particle movement devices have appeared. In particular, methods of manipulating particles on wave guides by the use of evanescent waves generated at the surface of a single mode wave guide are known; this technique is described by S. Kawata et al. in "Optically driven Mie particles in an evanescent field along a channelled wave guide" Optics Letters, Vol. 21, No. 21, pages 1768-1770, 1996.

This technique can be used to collect randomly dispersed particles above a guide (based on gradient forces), and then to move these particles along the guide (diffusion forces). The method is also applicable to metallic particles but it has the disadvantage that it is very dependent on the surface condition of the guide; high roughness will definitively stop the particle.

Therefore, the problem arises of finding new particle movement methods.

Presentation of the Invention

The invention uses optical forces generated by a diffraction grating.

The purpose of the invention is a process for moving a particle using a device comprising a substrate, a wave guide and a grating formed on the wave guide, in which:

light with wavelength $\lambda$ is injected into the wave guide, the light transmitted through the guide is diffracted to a medium with an index nsup in which the particle is located.

Particle movement forces are generated by diffraction of light output from the grating and are oriented as a function of the grating characteristics.

The grating is used as an element that decouples light propagating in a wave guide. The light may be injected into the guide by means of coupling through the edge, through a prism, or using another grating.

Light output from the grating is used as a genuine driving force capable not only of moving particles, but also choosing their trajectories and their speeds.

The invention also relates to a device comprising a substrate, a wave guide and a grating formed on the wave guide, for moving a particle in a medium with index nsup.

This grating diffracts light with wavelength $\lambda$ transmitted through the guide, to an external medium with index nsuper.

Preferably, the grating only diffracts a single order towards the medium in which the particle is located.

According to yet another embodiment, no light is diffracted to the substrate.

For example, the effective index of the guide is neff, the grating pitch is $\Lambda$, the index of the substrate is nsub such that nsuper>nsub, and the ratio $\lambda/\Lambda$ is between neff−super and neff−nsub or between neff+nsub and neff+nsuper.

When the external medium is a liquid medium, the device may also comprise at least one intermediate layer between the substrate and the wave guide, this layer having a refraction index less than or equal to the refraction index of the liquid.

Preferably, the grating pitch $\Lambda$ is greater than or equal to $\lambda/(neff/nsup+1)nsup$, and/or less than or equal to 2. $\lambda/(neff/nsup+1)nsup$, where neff is the effective index of the wave guide.

The substrate may also comprise means of reflecting light diffracted to the substrate, for example a Bragg mirror.

According to one variant, the grating comprises several types of patterns, a first type of patterns, and at least a second type of patterns different from the first type, for example at least due to its pitch and/or a lateral dimension and/or its height.

Preferably, the lateral extension of at least part of the wave guide is less than the lateral extension of the grating.

The grating may also be curved.

The invention can be used to move particles, for example with a diameter of between 5 nm and 100 μm.

Moreover, the invention enables particle movement at a speed for example greater than 500 nm/s or 1 μm/s or 5 μm/s.

The invention also relates to a sort process for particles with different refraction indexes or different sizes, in which a movement process like that described above is used.

DETAILED DESCRIPTION OF EMBODIMENTS OF THE INVENTION

Figure 1:
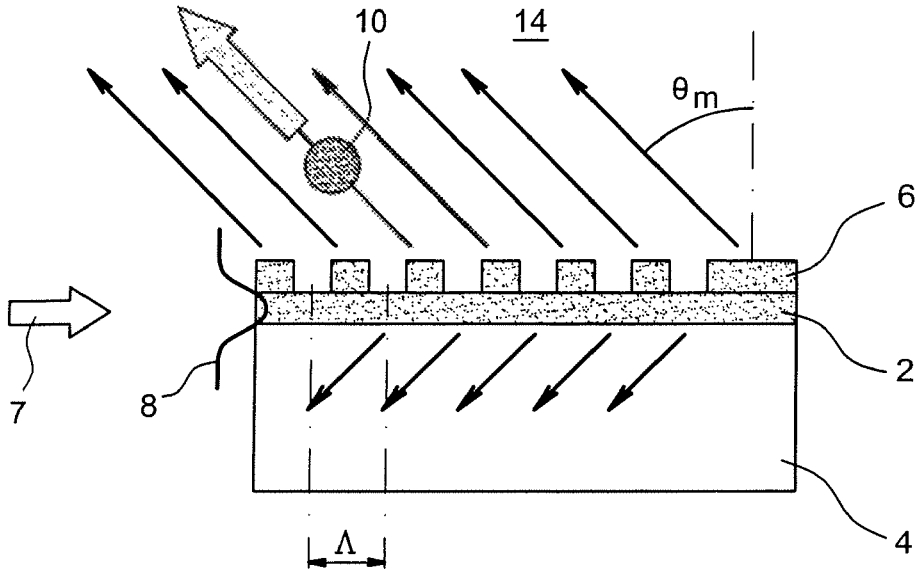
FIG. 1 represents a first embodiment of the invention.

A first embodiment is described with reference to FIG. 1.

A wave guide 2 is formed on a substrate 4. A diffraction grating 6 is located on or is deposited on or is formed on this guide 2. Radiation 7 (one mode of which is denoted by reference 8) is injected into the guide 2, for example using coupling through the edge, by means of injecting radiation at the required wavelength into the guide. For example, such means include a prism or another grating.

The grating 6 decouples light from guided mode towards the exterior.

Therefore, the grating patterns will decouple injected light and will generate a diffraction phenomenon above the grating 6 in the medium 14 and below the grating 6 in the substrate 4.

In the medium 14, diffracted light generates an "optical force" that for example acts on a particle 10 close to the grating.

The direction of the diffracted wave, denoted by angle θm, is given by:

$$\sin(\theta_m) = \frac{neff}{nd} + m \cdot \frac{\lambda}{\Lambda \cdot nd} \tag{1}$$

where:

neff is the effective index of the wave guide 2, that depends on the indexes of the guide 2 and the substrate 4, nd is the index of the medium in which the wave is diffracting (substrate 4 or superstrate 14), m is the diffracted order considered, λ is the wavelength of the injected radiation 7, Λ is the spatial pitch of the diffraction grating 6.

For reasons of simplicity, this formula (1) is approximate, like all other formulas given below.

For a working wavelength λ, the pitch of the grating Λ can be chosen so as to choose θm and therefore the direction of the diffracted wave, and therefore the direction in which the particles 10 will move.

If diffraction order m=−1 is considered, it can be seen that this order will start to be diffracted if:

$$\sin(\theta_m) = \frac{neff}{nd} - 1 \cdot \frac{\lambda}{\Lambda \cdot nd} > -1 \tag{2}$$

Therefore, decoupling of this order begins for a minimum pitch:

$$\Lambda_{\min} = \frac{\lambda}{\left(\frac{neff}{nd} + 1\right)nd} \tag{3}$$

There is a negative diffraction angle equal to −90° associated with this limiting pitch. The result is then quasi-horizontal propulsion of the particles.

If the pitch is increased, the diffraction angle increases and then takes on positive values; therefore the propulsion direction may be inverted. However, if the grating pitch further increases, decoupling of the order −2 of the grating occurs. In this case, two diffraction directions are superposed. Therefore, an upper limit of the grating pitch must be respected in order to provide optimum guidance of the particles, given by:

$$\Lambda_{\max} = \frac{2 \cdot \lambda}{\left(\frac{neff}{nd} + 1\right)nd} \tag{4}$$

Thus, a grating is preferably used with a pitch between the two limiting pitches given by formulas (3) and (4) so that diffraction occurs for only one order, and therefore particles are propelled in only one direction.

Figure 2:
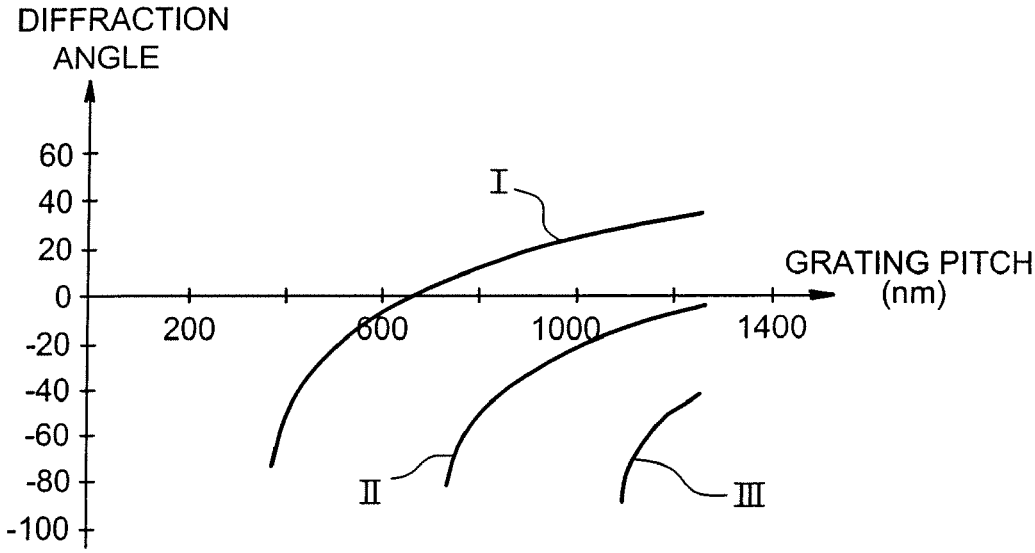
FIG. 2 represents the diffraction angles of the different orders as a function of the grating pitch, in a device according to the invention.

This phenomenon is illustrated in FIG. 2 that shows the diffraction angles of the different orders (order −1-curve I; order −2-curve II; order −3-curve III) of a grating as a function of the pitch of this grating. The superstrate 14 considered has an index equal to 1.33 (identical to the index of water) and the wave guide 2 under the grating has an effective index equal to 1.6. The working wavelength is 1064 nm.

There is no decoupling phenomenon for a very small grating pitch, and therefore no diffracted order.

The limiting diffraction pitch (3) of the grating is reached when Λ=363 nm, under the conditions specified above; the direction of the diffracted wave is then −90°, which means that the particle moves in the direction opposite the light in the guide.

If this pitch is further increased, the diffraction angle also increases. For a grating pitch of between 363 and 726 nm, only order −1 is diffracted by the grating and its direction can vary between −90° and +5.8°.

The diffraction angle becomes zero for Λ=665 nm; the particle is then in simple levitation above the grating.

A further increase in the pitch causes inversion of the diffraction direction (positive angles) and inversion of the direction of the particle. The diffraction limit of the order of −2 is then reached for Λ=726 nm.

Thus, working within a pitch range varying between 363 and 726 nm, the diffraction direction can be varied between −90° and +5.8°. In this configuration, only order −1 is diffracted by the grating and the entire radiation takes place in the same direction.

It would also be possible to work with a pitch greater than the limit (4) expressed above, therefore greater than the value 726 nm in the example given above, but the particle movement is then more complicated.

The particle 10 placed above the grating 6 will be struck by the diffracted wave that will push it in the chosen direction.

The forces applied on the particles are expressed as follows:

$$F = \frac{nd}{c}(C_{scat} + C_{\text{abs}})I$$

where Cscat and Cabs are the effective diffusion and absorption sections of the particle, I is the intensity diffracted by the grating 6 and nd is the index of the superstrate 14.

Effective sections depend directly on the optical index of the particle, and also on its volume. Thus, two particles made of different materials or with different sizes will have different movement speeds, which for example means that these particles can be sorted. For example, a gold ball with a 1 μm diameter will move more quickly than a latex ball with the same size.

The device thus described has the property that it can move particles (or biological objects) with no contact and at high speeds (several microns per second or more) with size measured in micrometers or nanometres, for example this size varying between 10 μm and 50 nm. Moreover, it can be used to sort different natures or sizes of particles.

Formula (1) shows that decoupling of light in the grating does not take place for all indexes in the external medium 14. If order −1 is always considered, it can be seen that there is no diffraction if the index of the medium considered is too small. The diffraction condition can be written as follows, for order −1:

$$neff - nd < \frac{\lambda}{\Lambda} < neff + nd \tag{5}$$

Thus, in the configuration of the device described above, if $n_{super}$ represents the index of the medium 14, there will be a diffracted intensity in this medium if:

$$neff + n_{super} > \frac{\lambda}{\Lambda} \tag{6}$$

Similarly if $n_{sub}$ represents the index of the substrate 4, an intensity will be effectively diffracted in this substrate if:

$$neff + n_{sub} > \frac{\lambda}{\Lambda} \tag{7}$$

The efficiency of the device can be increased and light losses in the substrate 4 can be reduced, by working under index conditions (superstrate 14 and substrate 4) that enable diffraction in the superstrate 14 but not diffraction in the substrate 4.

Figure 3A:
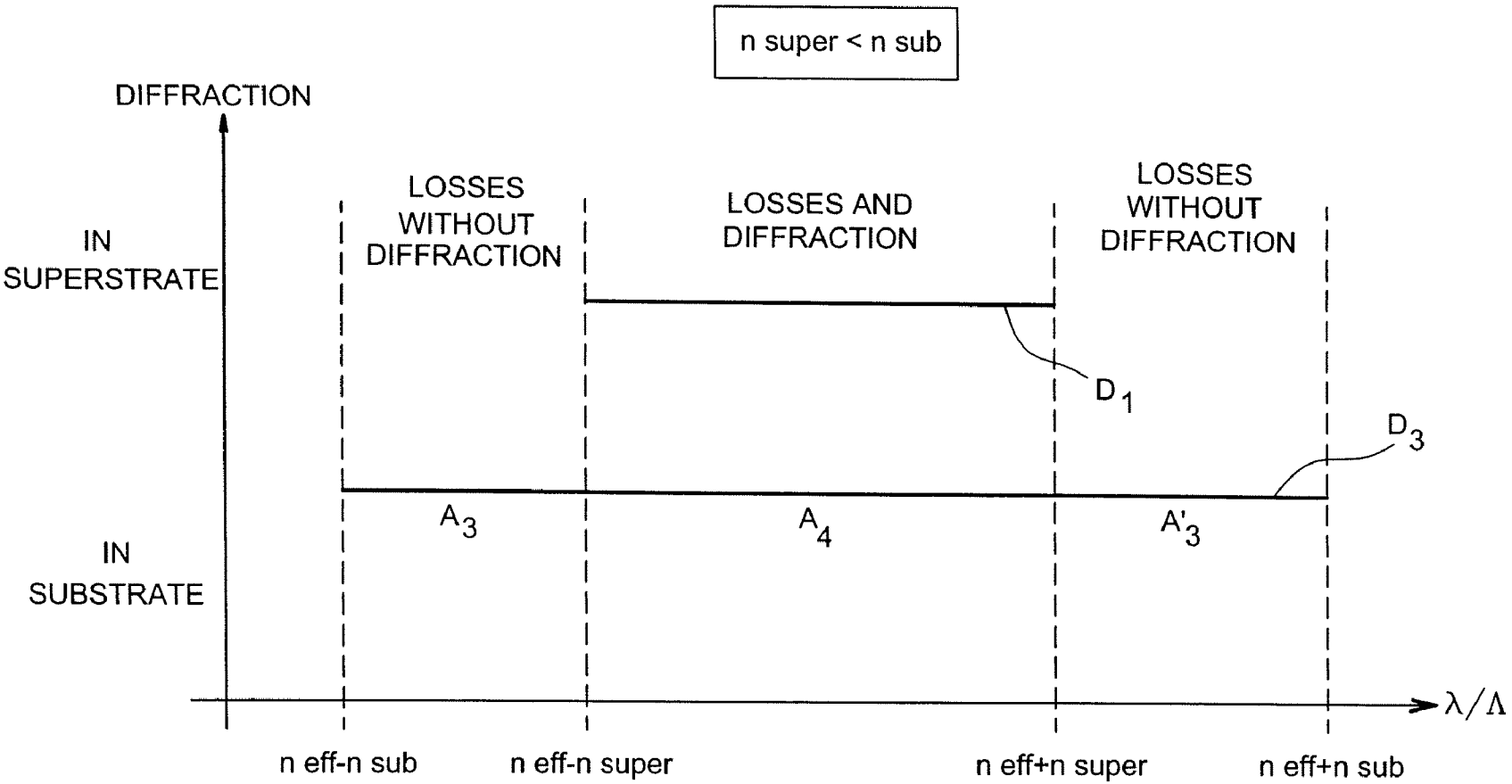
FIGS. 3A and 3B show the different possible cases as a function of the relative values of the indexes of the substrate and the superstrate in a device according to the invention.
Figure 3B:
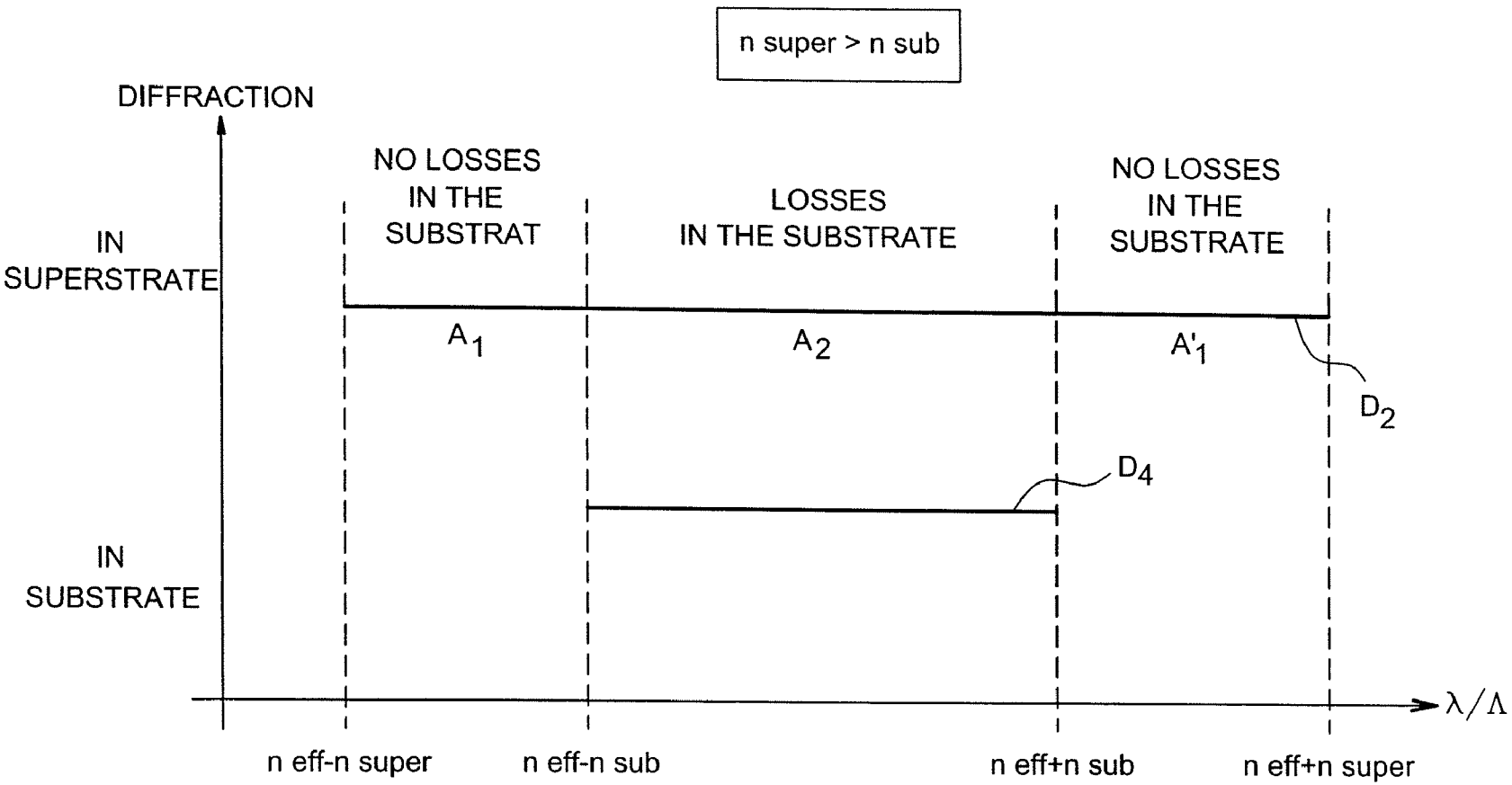

FIGS. 3A and 3B show different possible cases as a function of the relative values of the indexes of substrate 4 and the superstrate 14. FIG. 3A shows the case in which nsuper<nsub and FIG. 3B shows the case in which nsuper>nsub.

These two Figures indicate the cases in which diffraction does or does not take place in the substrate (straight lines D3 and D4) and in the superstrate (straight lines D1 and D2) as a function of the value of λ/Λ.

The straight lines D2 and D4 correspond to the case in which nsuper>nsub, and straight lines D1 and D3 correspond to the case in which nsuper<nsub.

Thus, in areas A1 and A'1 in FIG. 3B (nsuper>nsub and neff−nsuper<λ/Λ<neff−nsub (A1) or neff+nsub<λ/Λ<neff+nsuper (A'1)), diffraction takes place in the superstrate and there is no loss in the substrate. Losses appear in the substrate for area A2, in which diffraction always takes place in the superstrate, in other words when neff+nsub>λ/Λ>neff−nsub.

In areas A3 and A'3 (nsuper<nsub and neff−nsub<λ/Λ<neff−nsuper (A3) or neff+nsub<λ/Λ<neff+nsuper (A'3)), diffraction takes place in the substrate and not in the superstrate (therefore only losses and no diffraction). Diffraction takes place in the superstrate in area A4, in other words when neff+nsuper>λ/Λ>neff−nsuper.

Losses in the substrate can be limited by working in preference in areas A1 and A'1, therefore under the following conditions (8):

$$n_{super} > n_{sub} \text{ and}$$

$$neff - n_{super} < \lambda/\Lambda < neff - n_{sub}$$

$$\text{where } neff + n\text{sub} < \lambda/\Lambda < neff + n\text{super} \tag{8}$$

But it would also be possible to work in areas A2 and A4.

Figure 4:
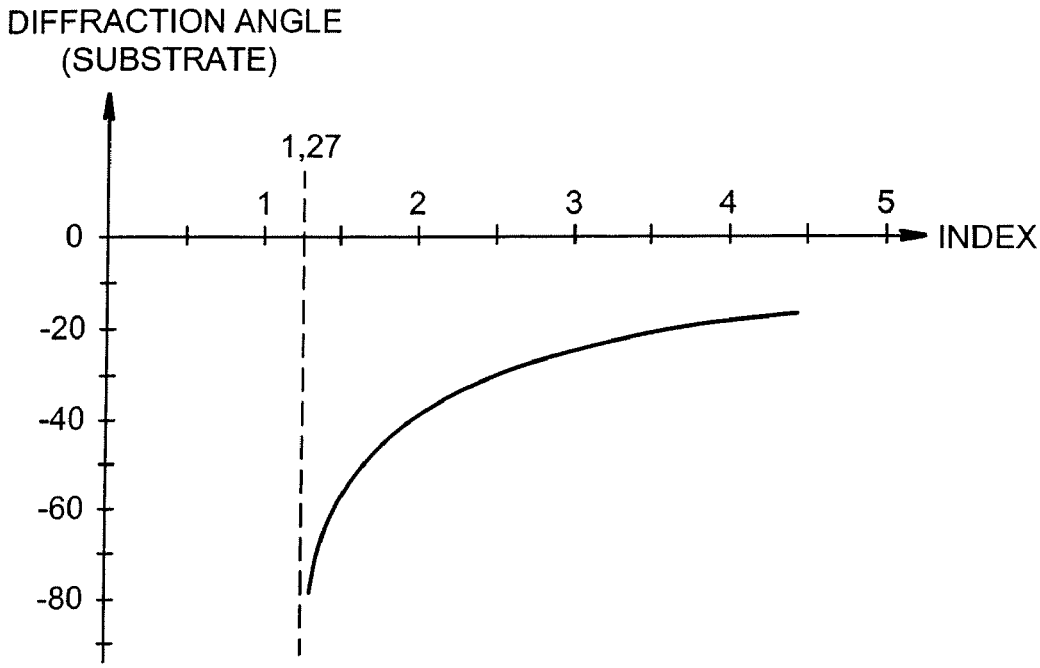
FIG. 4 shows an example variation of the diffraction angle in the substrate for a substrate with a variable index.

FIG. 4 gives an example in the case of mode n=−1; the coordinates axis gives the diffraction angle in the substrate for a substrate with a variable index (along the abscissa) for a grating pitch equal to Λ=370 nm, an effective index of the guide neff=1.6 and a wavelength λ=1064 nm.

If an external medium is considered with index nsuper=1.33, such as water, and a substrate with index nsub less than 1.27, loss phenomena in the substrate can be completely avoided and all decoupled light will be used to move particles (λ/Λ=2.8756, while neff+nsub<2.87 and neff+n super=2.97).

Thus, in the context of a particle movement in a liquid medium, it will be possible to envisage the use of an intermediate layer located between the substrate 4 and the wave guide 2, for which the index is less than the index of water. The result is thus a diffraction phenomenon in the water only, with no energy loss in the substrate. For example, this intermediate layer may be a silica layer deposited by a sol-gel technology with an index of about 1.22.

Figure 5:
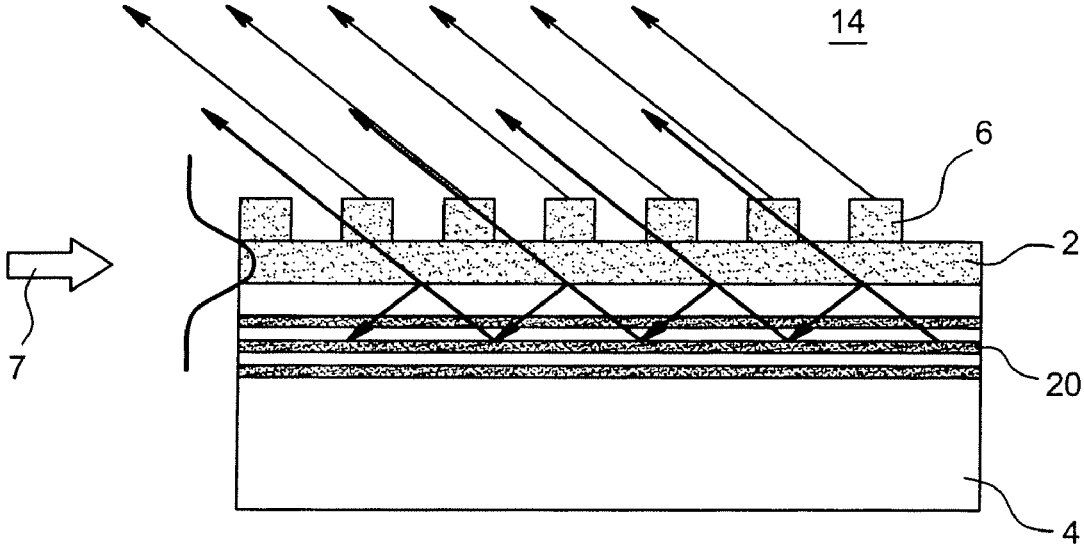
FIGS. 5-8B represent various other embodiments of the invention.

Another embodiment is shown in FIG. 5. It consists of placing a Bragg mirror 20 in the substrate 4.

This mirror sends light diffracted in the substrate 4, to the external medium 14.

Thus, the energy transfer to the external medium 14 is optimised.

The multi-layer deposit 20 comprises an alternation of dielectric thin films that do not absorb light at the wavelength of the beam 7. These will successively have a high refraction index denoted nh (possible materials include TiO2, HfO2, Si3N4, Ta205, Al203, In203) and a low index denoted nb (possible materials include SiO2, MgF2, LiF).

For example, it may be done by physical vapour deposition (PVD) or chemical vapour deposition (CDV), or a sol-gel method.

If the diffraction angles in the substrate 4 are denoted θ, namely θh, θb for the top index film and the bottom index film respectively, and ns is the index of this substrate, we have:

$$nh*\sin(\theta h) = nb*\sin(\theta b) = ns*\sin(\theta) \tag{9}$$

The thicknesses eb and eh of the thin layers with low and high index respectively are related to nb, θb and to nh, θh by the following relations:

$$eb = \lambda/(4*nb*\cos(\theta b)) \tag{10}$$

$$eh = \lambda/(4*nh*\cos(\lambda h)) \tag{11}$$

where λ is the incident wavelength.

After reflection on this mirror and after once again passing through the grating, the direction of the wave reflected by the mirror will be the same as the direction of the wave output from the grating 6 towards the superstrate.

It would also be possible to add a buffer layer between the mirror and the guide with an index less than the index of the guide, which avoids decoupling of light in the mirror.

Regardless of the envisaged embodiment, the direction of the particle 10 is related to the pitch of the grating. Therefore devices can be made for which the trajectory of the particle is genuinely controlled by controlling the pitch of the grating. As described above, the diffraction angles can be varied between −90° and +5° by controlling the pitch of the grating. For example, in FIG. 6, a particle 10 injected at the right will enter in levitation by the action of diffracted waves 22, these waves having a large or preponderant vertical component, and then be moved towards the left side of the Figure by the waves 23 and then 24, progressively becoming more inclined from a vertical direction.

Figure 6:
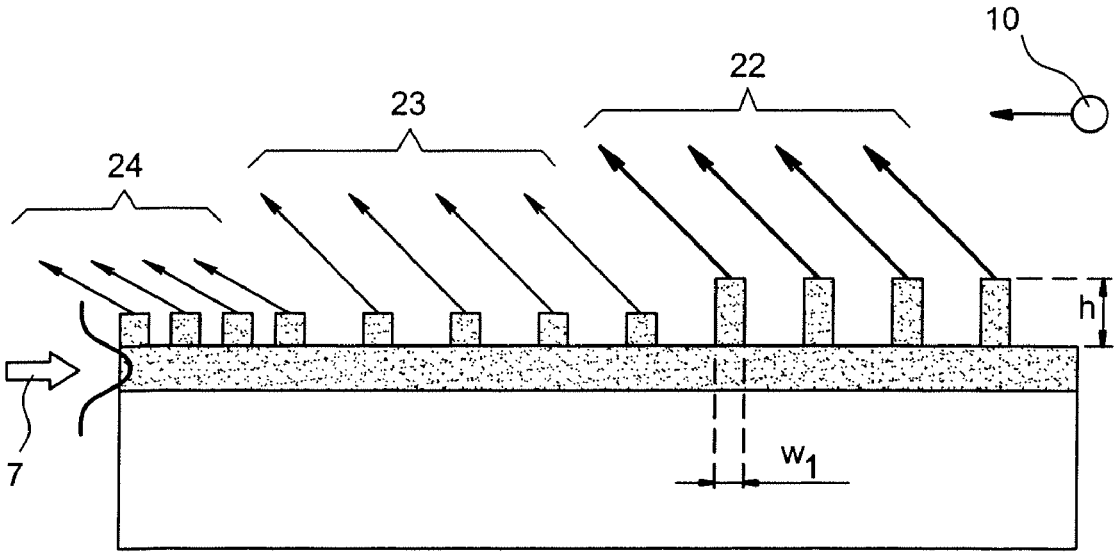
Figure 7A:
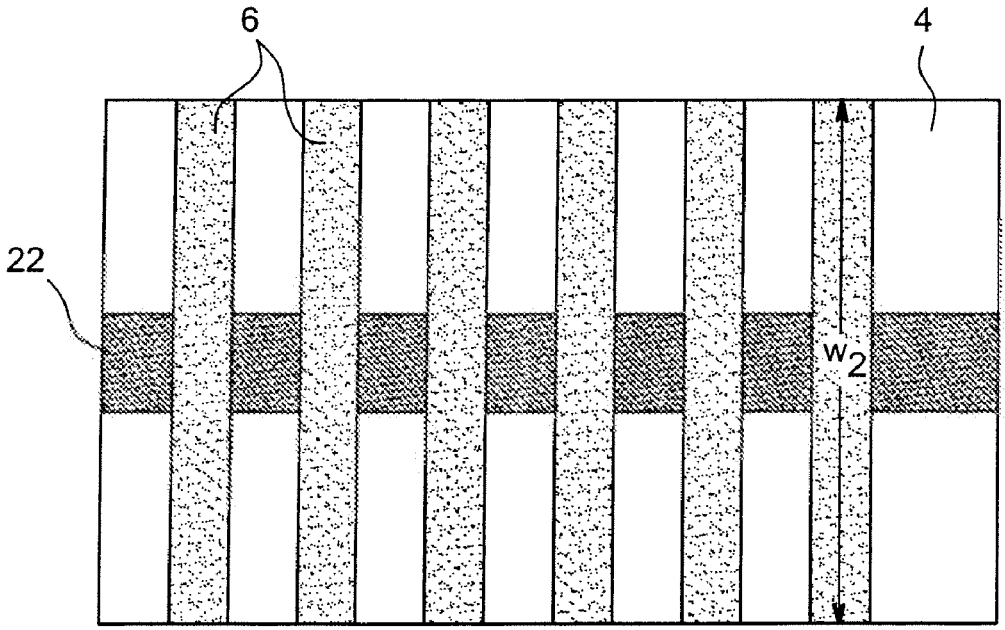

According to yet another embodiment, the particle speed can be varied and controlled by controlling the diffracted intensity; the lateral dimensions of the grating pattern (width w1 as shown in FIG. 6 and/or width w2 measurement along a direction perpendicular to the plane in FIG. 6 and as shown in FIG. 7A and/or its height h enable control of the diffracted energy.

For example, variations of the grating pitch and its lateral dimensions will be made using an appropriate mask. Variations of the height of the patterns will be made either by using several masking levels or by the use of layers with thickness gradients associated with a selective etching.

The grating used may comprise several patterns, each pattern being different from the other patterns, for example by at least its pitch and/or a width w1 or w2 and/or its height h.

Figure 7B:
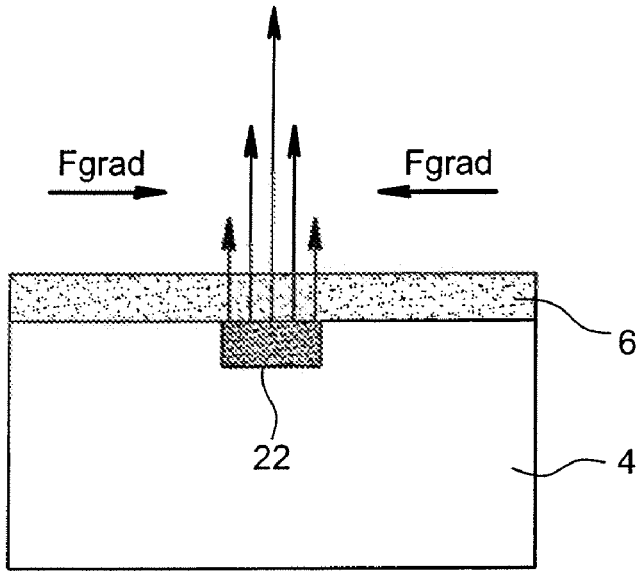

According to yet another embodiment that may be combined with any one of the embodiments presented above, particles are confined on a track by using a wave guide 22 under the grating 6 with limited width (FIG. 7A that shows a top view of the device). In this way, the lateral extension of the field is limited which generates a lateral gradient force Fgrad and that centres particles on the track above the guide 22 (FIG. 7B).

According to another embodiment, which may also be combined with the different embodiments presented above, the lateral extension of the grating is limited and its ends are curved.

Figure 8A:
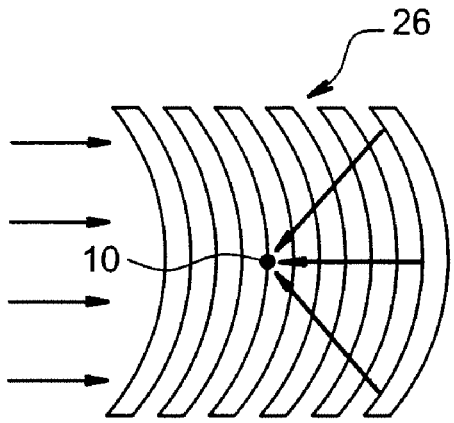
Figure 8B:
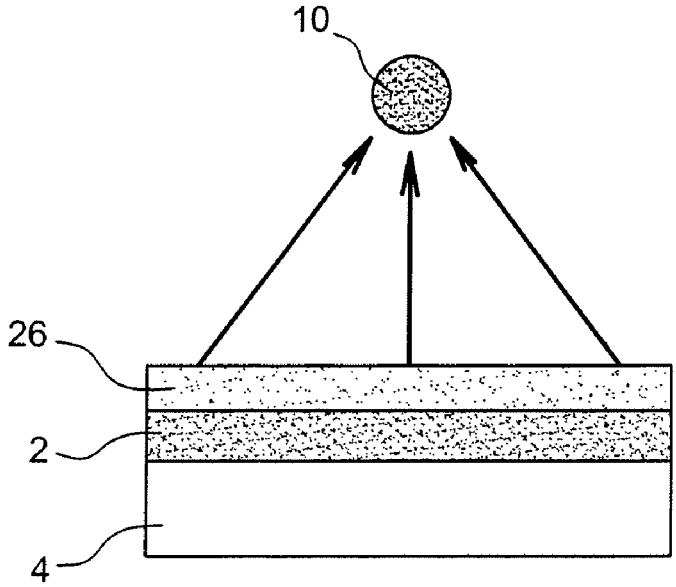

This embodiment is represented in FIGS. 8A (diagrammatic top view) and 8B. It is used to generate a "lateral" diffraction of the radiation, which will meet the particle and will guide it along a "focal line". The position of the particle in the three dimensions in space will thus be controlled, so that more complicated trajectories can be envisaged (for example a non-linear trajectory or a trajectory that meanders, or a curved trajectory in a plane parallel to the substrate). Production of this type of device is similar to production of the basic device but it uses a mask on which curves are printed, instead of traditional grating lines.

According to one example embodiment, the wave guide may be made by a traditional ion exchange process with silver ions on a BK7 substrate. The thickness of the guide will be chosen so as to work with a single mode guide for the required wavelength. Any dielectric material could also be used to enable efficient guidance of light or to work on a silicon substrate.

The grating could also be made of resin, titanium oxide (TiO2) or nitride. It may be etched by an electron beam lithography technology, or by a precision lithography technology.

Another example embodiment relates to a structure with a Bragg mirror, as in FIG. 5.

For example, the substrate 4 can be made of silicon.

This substrate is covered by a Bragg mirror 20 that prevents light leakages into the substrate. For example, for a working wavelength of 1064 nm, the substrate can be covered by a multi-layer 20 composed of an alternation of thin silica layers each 264 nm thick and thin titanium dioxide layers each 123 nm thick deposited in IBS. The multi-layer will be composed of 20 thin layers, and will then be covered by a 2 μm thick silica insulation layer. The mirror thus made can reflect all beams arriving within an angular range from 35° to 70°.

For example, the wave guide 2 may be made of nitride (Si3N4) using traditional deposition techniques (for example LPCVD). A nitride thickness equal to 223 nm and a 1 μm wide guide could then be chosen.

The grating 6 will be made of resin, titanium oxide (TiO2) or nitride using several superposed masking levels that enable a spatial variation of the grating thickness.

It may be etched using an electron beam lithography technology or by a precision lithography technology. A pitch varying between 353 and 706 nm could be chosen, to vary the angle between −90° and 7.8°.

What is claimed:

1. A process for moving a particle with a device, said device comprising a substrate, a wave guide and a grating, the process comprising:

injecting light with wavelength λ into the wave guide, wherein the wave guide is disposed on the substrate;

diffracting, with the grating, the light transmitted through the guide to a medium with an index nsuper in which the particle is located, wherein the grating is disposed on the wave guide; and moving said particle above the grating and through said medium by imparting motion to said particle through said medium in a predetermined direction, dependent upon a grating pitch, with a force generated by the diffracting of the light from the grating, said force being expressed as follows:

$$F = nd/c(C_{scat}+C_{abs})I,$$

wherein $C_{scat}$ and $C_{abs}$ are effective diffusion and absorption sections of the particle, I is an intensity diffracted by the grating, nd is the index nsuper of the medium, and c is speed of light.

2. The process according to claim 1, the grating only diffracting a single order towards the medium in which the particle is located.

3. The process according to claim 1, in which no light is diffracted to the substrate during the injecting and the diffracting.

4. The process according to claim 3, in which the effective index of the guide is neff, the grating pitch is Λ, the index of the substrate is nsub such that nsuper>nsub, and the ratio λ/Λ is between neff−nsuper and neff−nsub or between neff+nsub and neff+nsuper.

5. The process according to claim 1, the medium being a liquid medium, the device also comprising at least one intermediate layer between the substrate and the wave guide, the at least one intermediate layer having a refraction index less than the refraction index of the liquid.

6. The process according to claim 1, in which the grating pitch Λ is greater than or equal to λ/(neff/nsuper+1)nsuper, where neff is the effective index of the wave guide.

7. The process according to claim 1, in which the grating pitch Λ is less than or equal to 2·λ/(neff/nsuper+1)nsuper, where neff is the effective index of the wave guide.

8. The process according to claim 1, the substrate also comprising means for reflecting light diffracted to the substrate.

9. The process according to claim 7, the substrate comprising a Bragg mirror.

10. The process according to claim 1, the grating comprising first patterns, and at least second patterns different from the first patterns.

11. The process according to claim 10, the second patterns being different from the first patterns at least due to its pitch and/or a lateral dimension and/or its height.

12. The process according to claim 1, the lateral extension of at least part of the wave guide being smaller than the lateral extension of the grating.

13. The process according to claim 1, the grating being curved.

14. The process according to claim 1, wherein the step of moving the particle through said medium is performed so that said particle follows a curved trajectory in a plane parallel to the substrate.

15. The process according to claim 1, the particle diameter being between 5 nm and 100 μm.

16. The process according to claim 1, wherein the step of moving the particle through said medium is performed so that the particle moves through said medium at a speed greater than 500 nm/s.

17. A sorting process for sorting particles with different refraction indexes or different sizes, said sorting process comprising the process according to claim 1.

18. A device for moving a particle, comprising:

a substrate;

a wave guide that is disposed on the substrate; and a grating disposed on the wave guide, the grating diffracting light with wavelength λ transmitted through the guide to an external medium with index nsuper located above the grating, wherein the grating diffracts light with wavelength λ transmitted to said external medium in which a particle is located, and wherein said grating is configured to move said particle above the grating and through said external medium by imparting motion to the particle through said external medium in a predetermined direction, dependent upon a grating pitch, with a force generated by the light diffracted from the grating, said force being expressed as follows:

$$F = nd/c(C_{scat}+C_{abs})I,$$

wherein $C_{scat}$ and $C_{abs}$ are effective diffusion and absorption sections of the particle, I is an intensity diffracted by the grating, nd is the index nsuper of the external medium, and c is speed of light.

19. The device according to claim 18, the grating only diffracting a single order with wavelength λ .

20. The device according to claim 18, no light with wavelength λ being diffracted to the substrate while light is injected into the waveguide and diffracted by the grating.

21. The device according to claim 18, the guide having an effective index of neff and the grating having a pitch Λ, the substrate having an index nsub such that nsuper>nsub, and the ratio λ/Λ is between neff−nsuper and neff−nsub or between neff+nsub and neff+nsuper.

22. The device according to claim 18, also comprising at least one intermediate layer between the substrate and the wave guide, the at least one intermediate layer having a refraction index less than or equal to the refraction index of a liquid.

23. The device according to claim 22, the intermediate layer being a silica layer.

24. The device according to claim 18, the grating pitch Λ being greater than or equal to λ/(neff/nsuper+1)nsuper, where neff is the effective index of the wave guide.

25. The device according to claim 18, the grating pitch Λ being less than or equal to 2·λ/(neff/nsuper+1)nsuper where neff is the effective index of the wave guide.

26. The device according to claim 18, the substrate also comprising means for reflecting light diffracted to the substrate.

27. The device according to claim 26, the substrate comprising a Bragg mirror.

28. The device according to claim 26 also comprising a layer with an index less than the index of the guide and located between the guide and the reflection means.

29. The device according to claim 18, the grating comprising one first type of patterns and at least one second type of patterns, different from the first.

30. The device according to claim 29, the second type of patterns being different from the first type, for example at least due to its pitch and/or a lateral dimension and/or its height.

31. The device according to claim 18, the grating following a curved trajectory in a plane parallel to the substrate.

32. A device for moving a particle, comprising:

a substrate;

a wave guide disposed on the substrate; and a grating disposed on the wave guide, the grating diffracting light with wavelength λ transmitted through the guide, to an external medium having index nsuper, wherein said external medium is located above said grating and contains said particle, a particle movement force is generated by the diffraction of light from the grating, and said grating is configured to move said particle above the grating and through said external medium by imparting translational motion to the particle through said external medium in a predetermined direction, dependent upon a grating pitch, with said force, said force being expressed as follows:

$$F = nd/c(C_{scat}+C_{abs})I,$$

wherein $C_{scat}$ and $C_{abs}$ are effective diffusion and absorption sections of the particle, I is an intensity diffracted by the grating, nd is the index nsuper of the external medium, and c is speed of light.

33. The process according to claim 16, wherein the step of moving the particle through said medium is performed so that the particle moves through said medium at a speed greater than 1 μm/s.

34. The process according to claim 33, wherein the step of moving the particle through said medium is performed so that the particle moves through said medium at a speed greater than 5 μm/s.

35. The process according to claim 1,wherein the step of moving the particle through said medium includes controlling a particle speed through said medium by controlling an intensity of the light diffracted from the grating.

36. The process according to claim 1, wherein the step of moving the particle through said medium includes controlling a particle trajectory by controlling a pitch for said grating.

37. The process according to claim 1, wherein the step of moving the particle through said medium includes propelling said particle in only one direction.

38. The device according to claim 18, wherein the grating is configured to sustain a controlled movement of said particle through said external medium over a predetermined trajectory.

39. The device according to claim 38, wherein said predetermined trajectory is in a plane parallel to a surface of said substrate.

* * * * *

UNITED STATES PATENT AND TRADEMARK OFFICE

CERTIFICATE OF CORRECTION

PATENT NO. : 7,633,056 B2
APPLICATION NO. : 11/671050
DATED : December 15, 2009
INVENTOR(S) : Gaugiran et al.

It is certified that error appears in the above-identified patent and that said Letters Patent is hereby corrected as shown below:

On the title page, the Terminal Disclaimer information has been omitted. Item (45) and the Notice information should read as follows:

--(45) **Date of Patent: *Dec. 15, 2009**

(*) Notice: Subject to any disclaimer, the term of this patent is extended or adjusted under 35 U.S.C. 154(b) by 0 days.

This patent is subject to terminal disclaimer.--

Signed and Sealed this

Second Day of February, 2010

David J. Kappos

David J. Kappos
*Director of the United States Patent and Trademark Office*